US009933198B2

(12) United States Patent
Benfatti et al.

(10) Patent No.: US 9,933,198 B2
(45) Date of Patent: Apr. 3, 2018

(54) ENDOTHERMIC FOOTWEAR INSERT

(71) Applicants: Eugene L. Benfatti, Scotch Plains, NJ (US); JoAnne Leff, New York, NY (US)

(72) Inventors: Eugene L. Benfatti, Scotch Plains, NJ (US); JoAnne Leff, New York, NY (US)

( * ) Notice: Subject to any disclaimer, the term of this patent is extended or adjusted under 35 U.S.C. 154(b) by 114 days.

(21) Appl. No.: 14/956,928

(22) Filed: Dec. 2, 2015

(65) Prior Publication Data

US 2016/0091240 A1 Mar. 31, 2016

Related U.S. Application Data

(60) Provisional application No. 62/234,286, filed on Sep. 29, 2015.

(51) Int. Cl.
*F25D 5/00* (2006.01)
*B23P 15/26* (2006.01)
(Continued)

(52) U.S. Cl.
CPC ..... *F25D 5/02* (2013.01); *A43B 7/005* (2013.01); *A43B 7/02* (2013.01); *F25D 5/00* (2013.01)

(58) Field of Classification Search
CPC ..... F25D 5/00–5/02; A43B 7/005–7/02
(Continued)

(56) References Cited

U.S. PATENT DOCUMENTS 4,462,224 A * 7/1984 Dunshee ..... A61F 7/106 206/219
4,522,640 A * 6/1985 Jagoe, III ..... A61F 7/106 607/105

(Continued)

FOREIGN PATENT DOCUMENTS

DE 1873045 5/1963
DE 202013100621 4/2013

OTHER PUBLICATIONS

International Search Report and Written Opinion of the International Searching Authority for PCT/US16/53224 dated Dec. 9, 2016.

*Primary Examiner* — Tareq Alosh
(74) *Attorney, Agent, or Firm* — Cooper & Dunham LLP

(57) ABSTRACT

A personal cooling device that provides cooling to a user, e.g., a wearer's feet, assuring even temperature distribution across contoured surfaces irrespective of the orientation of the personal cooling device and regardless of the pull of gravity. The personal cooling device includes a flexible non-porous upper component, a flexible non-porous lower component, a porous absorbent carrier component, at least one dry chemical reactant and at least one containment including at least one liquid reactant. The carrier component includes at least one dry chemical reactant distributed on the surface area thereof. When the at least one dry chemical reactant is combined with the at least one liquid chemical reactant and is absorbed by the carrier component, an endothermic reaction is produced. The carrier component absorbs the resulting cool substance evenly distributed thereover and, thereby assures equal distribution of this actual cooling throughout the entire device. The at least one containment is adapted to rupture under applied pressure. The upper and lower components are inseparably sealed to each other at their respective perimeters, the attachment
(Continued)

forming a volume adapted to encapsulate the carrier component, the at least one dry chemical reactant and the at least one containment.

10 Claims, 8 Drawing Sheets

(51) Int. Cl.
*F25D 5/02* (2006.01)
*A43B 7/00* (2006.01)
*A43B 7/02* (2006.01)

(58) Field of Classification Search
USPC ..... 62/4
See application file for complete search history.

(56) References Cited

U.S. PATENT DOCUMENTS 4,780,117 A * 10/1988 Lahey ..... A61F 7/106 126/263.07
5,123,411 A * 6/1992 Noziri ..... A61F 7/106 604/113
5,178,139 A 1/1993 Angelillo et al.
5,792,213 A 8/1998 Bowen
6,264,681 B1 * 7/2001 Usui ..... A43B 1/0054 607/108
6,328,761 B1 * 12/2001 Ueki ..... A43B 7/02 2/239
6,484,514 B1 * 11/2002 Joseph ..... B65D 81/3266 126/263.01
6,701,639 B2 3/2004 Treptow et al.
6,893,453 B2 5/2005 Agarwal et al.
7,017,283 B2 * 3/2006 Shows ..... A43B 7/081 36/3 B
7,021,848 B1 * 4/2006 Gruenbacher ..... A61M 35/003 126/263.08
8,015,728 B2 9/2011 Benfatti
8,745,894 B2 6/2014 Cheskin et al.
2002/0020407 A1 * 2/2002 Wohland ..... A45D 34/00 126/263.03
2004/0065315 A1 * 4/2004 Fish ..... A61F 7/03 126/263.08
2004/0123620 A1 * 7/2004 Porter ..... F25D 31/007 62/457.3
2006/0169276 A1 * 8/2006 Scudder ..... A47G 19/027 126/263.08
2006/0230633 A1 * 10/2006 Polenta ..... A43B 7/02 36/2.6
2008/0053109 A1 * 3/2008 Quincy ..... F25D 5/02 62/4
2008/0147153 A1 6/2008 Quincy et al.
2013/0174581 A1 * 7/2013 Rasmussen ..... F25D 5/02 62/4

* cited by examiner

ENDOTHERMIC FOOTWEAR INSERT

FIELD OF INVENTION

The present invention relates generally to a personal cooling device having even temperature distribution over the entire surface area of the device irrespective of the pull of gravity and orientation. This application claims priority to U.S. Provisional Application Ser. No. 62/234,286 filed on Sep. 29, 2015.

BACKGROUND

Every day, people experience discomfort and pain in various parts of their body, and particularly in their feet when their work, habitual sport, or leisure activity creates a situation in which they must stand, walk or run for long periods of time. Such resulting discomfort and pain may be relieved by personal cooling devices that have considerable limitations. Currently, there are no personal cooling devices in the prior art that can assure an equal distribution of its actual cooling temperature across any and all contours on which it is overlaid, either hands free on the body or on any orthotic or insole already in the footwear, since such devices are not thin enough or flexible enough to fit in a person's footwear with an orthotic or insole already in place. Since the personal cooling devices of the prior art fall prey to gravity's pull based on their free flowing liquid contents, they are, therefore, not able to provide equal distribution of their actual cooling temperature in any orientation regardless of the pull of gravity.

Typically, personal cooling devices of the prior art are also not designed solely to provide actual temperature cooling to an affected area. In addition, they are also typically not designed in the most elemental form and structure, unencumbered by features that require additional components and actions by the consumer. For example, U.S. Pat. No. 8,015,728 discloses a footwear insert in the shape of a foot including an array of dimples in a bottom component to hold various chemical reactants. A container is filled with a liquid chemical reactant. When the liquid is released, it reacts with the chemical reactant held in the dimples. This liquid mixture is free to flow within the footwear insert which results in a non-equal distribution of cooling.

U.S. Pat. No. 6,893,453 discloses a therapy pad with variable heating or cooling control which uses removable layers to control a level of temperature from the pad. These additional layers limit the flexibility of the therapy pad by making it much thicker and typically not suitable for use as a footwear insert overlay. Thus, there is a need for a personal cooling device for the body and one that is particularly suitable for use on one's feet, which should be disposable, economical and provides a self-contained solution as well as being ultra-thin and very flexible in order to not only fit inside footwear that already includes an orthotic or insole of any kind, but be capable of providing and assuring equal distribution of its actual cooling temperature, regardless of the pull of gravity and in any orientation, across all varying contours of any surface on which it is overlaid, whether hands free on the body or over an orthotic or insole which is already in the footwear.

SUMMARY

The present invention overcomes the drawbacks of the prior art and provides an economical, disposable, personal cooling device to do so. The personal cooling device of the present invention preferably includes a flexible non-porous upper and lower substrate and an absorbent porous carrier component. The personal cooling device also includes at least one dry chemical reactant distributed over the surface area of the carrier component. At least one frangible containment including at least one liquid reactant contained therein is provided within the device. The upper and lower non-porous substrates are sealed together, preferably around a perimeter thereof, to encapsulate the carrier component, dry chemical reactant(s) and at least one liquid filled containment. Upon rupturing the at least one frangible containment, the liquid is released and mixes with and reacts with the dry chemical reactant(s) to provide a cooling effect. The mixed dry chemical reactant(s) and liquid reactant(s) are evenly absorbed by the absorbent porous carrier component to provide the cooling effect over the entire surface area of the carrier component, and, thereby, over the entire surface area of the personal device, allowing for the equal distribution of the actual cooling temperature, irrespective of gravity's pull and any orientation.

In one preferred embodiment, the personal cooling device is in the form of a thin, flexible footwear insert overlay which conforms to any contours of any footwear, insole or orthotic on which it is overlaid. The footwear insert is simple to manufacture and is disposable. Thus, the footwear insert would be economical for the average consumer to use, even more than once a day. To maintain all the components tightly between the upper and lower non-porous substrate layers, the non-porous upper and lower substrates may also be vacuum sealed together to create a thin device which holds all components tightly in place and maintains the distribution of dry chemical reactant(s) over the surface area of the carrier component. The absorbent porous carrier component is comprised of absorbent, porous material(s) of any kind, structure and/or combination thereof, e.g. a sponge-like material. More particularly, the carrier component may be formed from, e.g., sponge, cellulose, pressed cotton, paper or wood pulp.

The personal cooling device of the present invention includes at least one containment having at least one seam portion which allows for the containment to be easily ruptured by applying hand pressure thereto. Rupturing the frangible containment allows the liquid reactant(s), such as water, along with the dry chemical reactant(s) to create the endothermic reaction with the resulting cooling substance being absorbed by the carrier component. The carrier component may be initially rigid, such as the case of dry sponge, which becomes highly flexible after it becomes wet allowing the footwear insert to follow all the contours of any footwear, insert or orthotic on which it is overlaid, and likewise, allowing the instant cold pack of the present invention to follow all the contours of any area of the body on which it is overlaid.

The personal cooling device may further include at least one margin area at one end of the device adjacent to the absorbent porous carrier component which provides a space to accommodate any negligible amount of liquid or air within the device after the reactants are mixed and absorbed by the carrier component. Preferably, the personal cooling device also includes an adhesive, e.g., around a perimeter thereof, to allow the device to adhere to a user's body area hands-free or a strip(s) or a piece(s) of adhesive on a bottom portion thereof to keep a footwear insert firmly attached to the footwear, insole or orthotic on which the insert is overlaid.

Also disclosed is a method of providing cooling to a portion of a user's body which includes the steps of providing a personal cooling device having a flexible non-porous upper component, a flexible non-porous lower component, a porous absorbent carrier component, at least one dry chemical reactant distributed over the surface area of the carrier component, and at least one containment adapted to hold at least one liquid chemical reactant, wherein said upper and lower components are inseparably sealed to each other at their respective perimeters and form a volume adapted to encapsulate said carrier component, dry chemical reactant(s) and said at least one containment therebetween; and applying pressure to rupture the frangible containment to release the at least one liquid chemical reactant; absorbing the at least one liquid chemical reactant by the carrier component to mix with and activate the at least one dry chemical reactant to produce an endothermic reaction, such that the distribution of the at least one dry chemical reactant on the carrier component and absorption of the resulting cooling substance by the carrier component provide a substantially even temperature distribution of such resulting cooling substance along the entire surface area of the device irrespective of the pull of gravity and orientation. The device is preferably a disposable, economical, flexible footwear insert overlay which can conform to any contours of any footwear, insole or orthotic on which it is overlaid. The method may further include the step of applying an adhesive which is covered by a release layer, such that when the release layer is removed, the adhesive is exposed. Additionally, in one embodiment, the at least one dry chemical reactant is urea and the at least one liquid reactant is water.

The present invention also includes a method of making a personal cooling device including the steps of providing a first flexible, non-porous substrate layer; placing an absorbent, porous carrier component on top of the first substrate layer; distributing at least one dry chemical reactant over the surface of the carrier component; providing at least one liquid filled containment including at least one liquid reactant therein which, when mixed with the at least one dry chemical reactant creates an endothermic reaction; placing the at least one liquid filled containment on top of the carrier component; providing a second flexible, non-porous substrate placed on top of the liquid filled containment; and sealing at least a perimeter of the first and second non-porous substrate layers to encapsulate the carrier component, dry chemical reactant(s) and at least one liquid filled containment. The method of making may also include the step of vacuum sealing to thereby tightly hold in place the at least one dry chemical reactant and the at least one containment relative to the carrier component. Furthermore, the at least one containment may include a seal therearound to hold the at least one liquid reactant such that at least a portion of the seal is adapted to rupture to allow the liquid to escape upon application of pressure to the at least one containment. Lastly, the method may further include the step of applying an adhesive and release layer over the adhesive to the non-porous substrate layer.

Before the embodiments of the invention are explained in detail with reference to the figures, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION

The present invention is a personal cooling device which can provide temporary cooling to a user, e.g., a wearer's feet. The present invention is preferably in the form of a footwear insert or a cooling pack which may be applied to the user's body to provide temporary relief from, e.g., discomfort caused by muscle soreness or general foot soreness. In a preferred embodiment, the personal cooling device assures even temperature distribution across all contoured surfaces to which it is applied irrespective of the orientation of the personal cooling device and regardless of the pull of gravity. The personal cooling device may take any shape or size desired for its intended purpose.

While the making and using of various embodiments of the present invention are discussed in detail below, it should be appreciated that the present invention provides many applicable inventive concepts which can be embodied in a wide variety of designs. The specific embodiments discussed herein are merely illustrative of specific ways to make and use the invention and various aspects of the invention, and do not limit the scope of the present invention.

Figure 1:
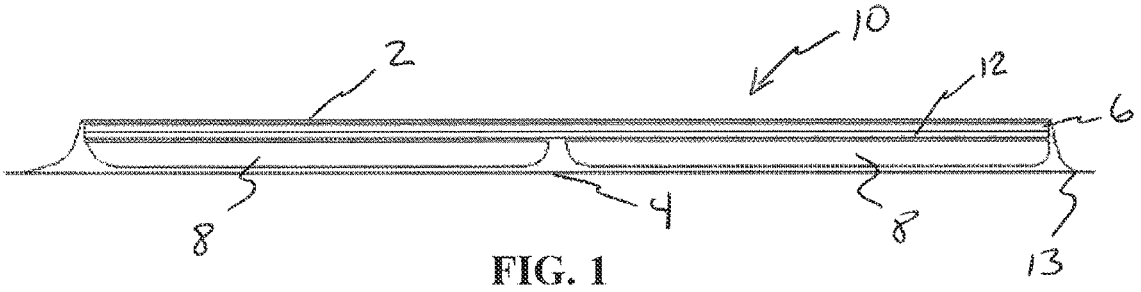
FIG. 1 is a cross-sectional side view of a personal cooling device in the form of a footwear insert.

Referring to FIG. 1, the personal cooling device 10 of the present invention includes a highly flexible, non-porous upper 2 and lower 4 component or substrate. The non-porous upper and lower components may be made from, e.g., a polyethylene film or any other highly flexible, non-porous substrate. As shown in FIG. 1, which is a cross-sectional view of a footwear insert made in accordance with the present invention, the non-porous upper and lower components are overlapped to allow for a perimetrical bonding seal 13 for the device. The perimeter seal 13 may be formed by any known means such as, e.g., thermobonding or ultrasonic sealing.

The personal cooling device 10 also includes a porous, absorbent carrier component 6 which is located below the upper non-porous substrate 2. The carrier component 6 is preferably a dense, porous, absorbent material or combination of materials which is adapted to absorb a liquid reactant or combination of liquid reactants. The at least one liquid reactant such as e.g., water, is provided in at least one frangible containment 8 provided below the carrier component and above the lower non-porous substrate 4. At least one dry chemical reactant 12, such as e.g., urea to produce an endothermic reaction is distributed over the surface area of the carrier component 6.

In a preferred embodiment, the endothermic reaction which provides a cooling effect uses at least one dry chemical reactant 12 which is a mixture of approximately 50% powdered prilled urea and approximately 50% urea prills. The urea prills are larger in particle size than the powdered prilled urea. This mixture has been found to provide both instant and sustained cooling for a desired time period. The cooling effect typically lasts for up to approximately ten (10) minutes, which is sufficient to provide cooling relief to a user's foot when used as a footwear insert or body when used as a cold pack. As noted above, the at least one dry chemical reactant 12 is distributed over the surface area of the carrier component 6 to provide an even cooling effect over the entire surface area of the device.

The carrier component 6 may be formed as a single continuous unit with the at least one dry chemical reactant provided on a top or bottom surface thereof. Alternatively, the carrier component 6 may be formed from at least two layers and the at least one dry chemical reactant may be distributed between the layers of the carrier component. A still further embodiment includes a carrier component in the form of shredded, absorbent sponge-like pieces wherein the at least one dry chemical reactant is distributed among the carrier component pieces. In yet a further embodiment, the carrier component 6 may be infused or impregnated with the at least one dry chemical reactant within the porous structure of at least one layer of absorbent material. The at least one dry chemical reactant may also be held in place on the carrier component by means of adhesion, infusion or simply filling the pores of the porous carrier component. Preferably, the carrier component may be formed from sponge, cellulose, pressed cotton, paper, wood pulp or any other porous, absorbent material known to those skilled in the art.

Figure 3:
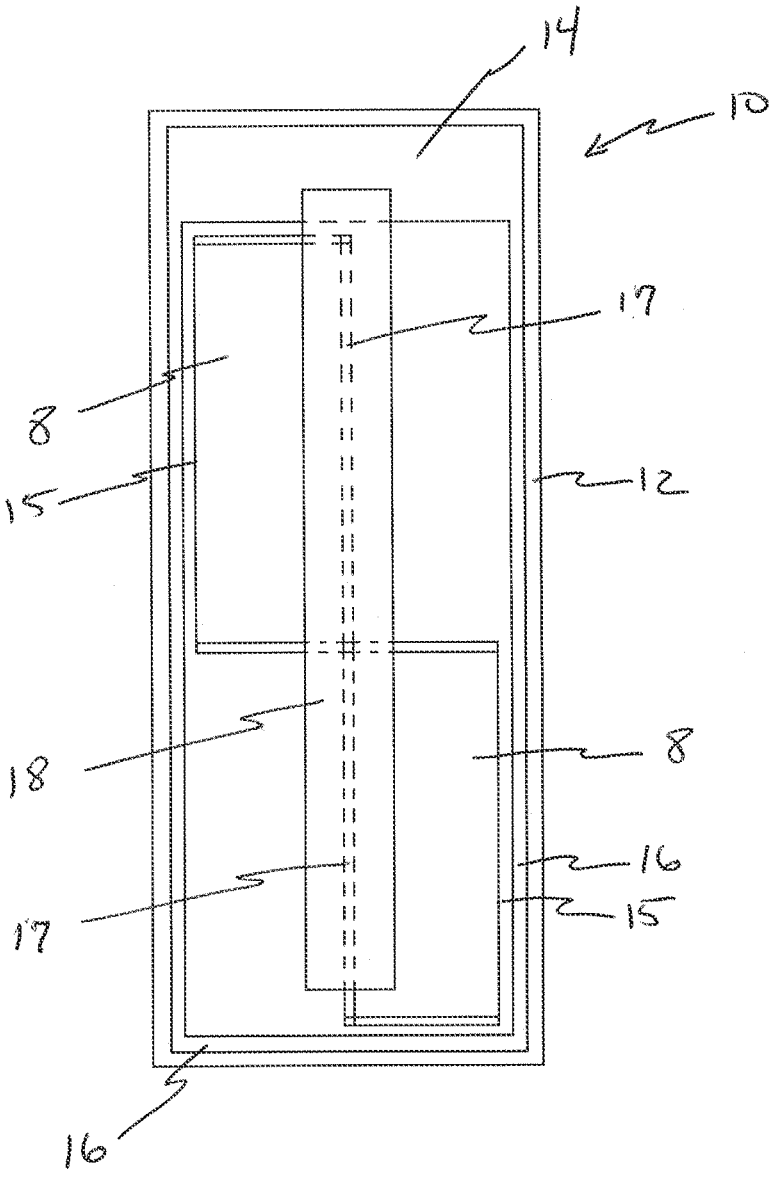
FIG. 3 is a bottom view of the footwear insert illustrated in FIG. 1 having two containments.

As noted above, the personal cooling device of the present invention includes at least one containment 8 for at least one liquid reactant. As shown in FIG. 1, two containments are provided; however, it is to be understood that any number of containments of any different size and shape may be used. The containment 8 may be made from any material which holds the at least one liquid reactant and be frangible, such as e.g., cellophane. In a preferred embodiment, the at least one liquid reactant provided in the containment 8 is water and the at least one dry chemical reactant is urea as discussed above. The containment 8 is designed to burst from applied pressure, such as by hand pressure. In order to make the containment 8 more easily burstable, the containment may include at least one highly frangible seam or seam portion 17, as shown in FIG. 3. In a preferred embodiment, one side seam is non-frangible 15 (FIG. 3) whereas the other three sides are frangible seams e.g., in the case of a rectangle. The three frangible seams are provided to increase the ability to burst the at least one containment by hand pressure.

The personal cooling device of the present invention includes an upper and lower non-porous component which are sealed together along the outer perimeter to encapsulate and hold the carrier component, dry chemical reactant(s) and at least one liquid filled containment. In a preferred embodiment, the perimeter seal is also accompanied by a vacuum sealing process to eliminate air between the sealed upper and lower non-porous components 2, 4, as shown in FIG. 1. The vacuum sealing provides various benefits including holding the dry chemical reactant(s) in place either on or between the layers of the carrier component to assure distribution of the dry reactant(s) over the surface area of the carrier component. Vacuum sealing also holds the liquid filled containment(s) in place relative to the carrier component. By vacuum sealing either a footwear insert preferred embodiment or an instant cold pack preferred embodiment, all the components are held fast during shipping, retail display, transportation by the consumer and before use. Furthermore, the use of vacuum sealing eliminates substantially all of the air from in between the sealed upper and lower non-porous components.

Figure 2:
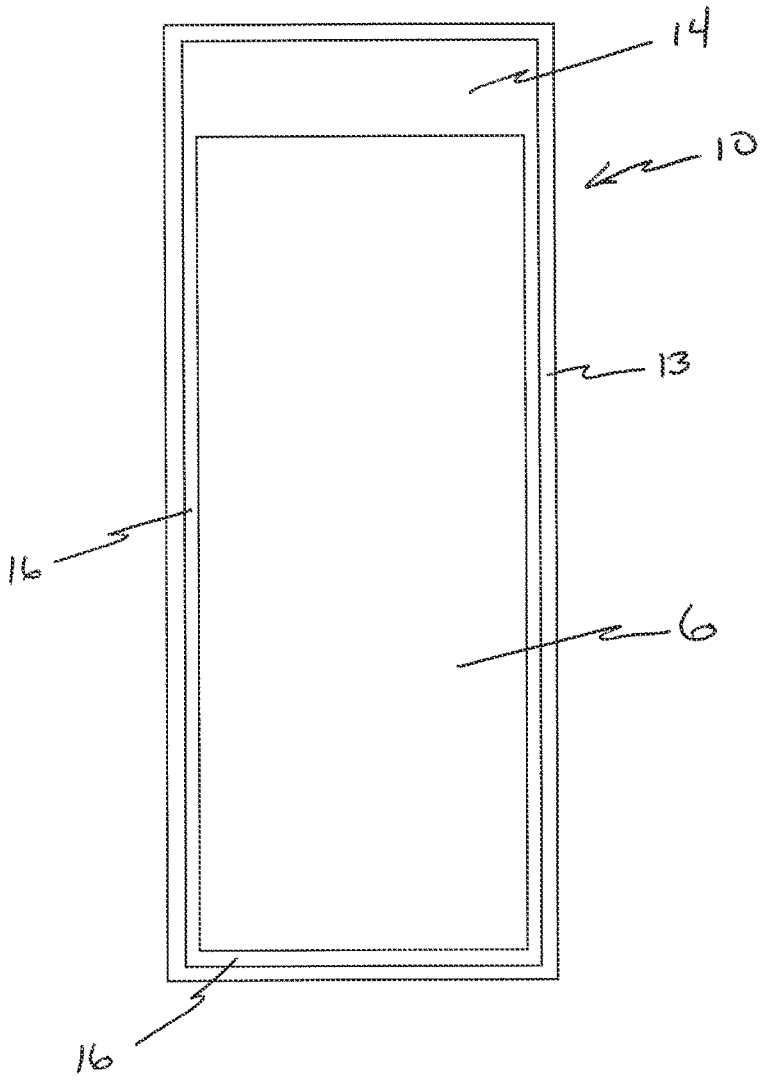
FIG. 2 is a top view of the footwear insert illustrated in FIG. 1.

FIG. 2 is a top elevation view of the personal cooling device as shown in FIG. 1. As shown in FIG. 2, there is a margin area between the carrier component and the perimeter seal 13 for the upper and lower non-porous components. As shown in FIG. 2, the margin area provided at a top end portion of the device 14 is larger than the margin area at the sides and bottom portion 16 of the device. The margin area allows any negligible air or water which may be present after bursting the containment and activating the at least one dry chemical reactant a place to go. In the case of a footwear insert, the larger margin area 14 falls in the toe area of the footwear insert. Thus, any small amount of air or liquid not absorbed by the carrier component naturally congregates in the larger margin area 14 and forms a slight "pillow" effect. This margin or pillow fits neatly between the ball of the wearer's feet and the pads of their toes to provide cooling and additional comfort.

As previously discussed, the absorbent carrier component absorbs the liquid reactant(s) upon bursting the containment(s). Since the carrier component 6 is formed from a sponge-like material in a preferred embodiment, in the case of a footwear insert, in the usual toe to heel movement of walking, the carrier component presses down on the toe area to the heel area in sequence over and over again with each step. When the toe area, for example, is pressed upon, the sponge releases some of the cooling liquid, to be immediately soaked up again into the toe area as the foot presses down on the heel area, thereby releasing some of the cooling liquid from the heel area, and so on. This constant releasing and soaking up of some liquid becomes a massage-like experience for extra comfort, if the wearer exaggerates this natural occurrence by a rocking back and forth motion of their feet, either while standing, sitting in place or walking. To enhance this massage-like effect, the upper non-porous component may include a textured or embossed pattern.

Referring to FIG. 3, the personal cooling device may also include at least one adhesive strip 18 or an adhesive(s) of any size or shape on the bottom surface of the device. For example, the adhesive may be a double-sided strip having one surface applied to the bottom non-porous component 4 of the device. The adhesive strip 18 may include a release layer made from, e.g., coated paper or plastic which is meant to be removed by the consumer prior to use. With respect to a footwear insert, the adhesive strip is provided on the bottom of the insert to hold the device in place with respect to the footwear in which it is placed or on which it is placed in the case of flip flops and other sandals as well as on all contours of any orthotic or insole on which it is overlaid. The adhesive strip is sticky enough to hold the device in place, yet leaves no trace of adhesive behind. Such adhesives are well known by those of ordinary skill in the art. In the case of a cooling pack, it is preferred that the adhesive be compatible for use directly on the skin of the consumer.

As shown in FIG. 3, the personal cooling device includes two containments which together span the length of the carrier component. The non-frangible side 15 is designed not to rupture upon applied pressure and three seams 17 are designed to rupture upon applied pressure thereby releasing the liquid reactant(s) contained therein. As will be appreciated by those skilled in the art, only one frangible seam or portion of a seam needs to be adapted to be ruptured to allow the liquid reactant to be expelled from the containment. Furthermore, the containments are sized only to hold the specific amount of liquid reactant(s) necessary to mix with the dry reactant(s) to create the resulting actual cooling temperature which is distributed over the entire surface area of the device.

Figure 4:
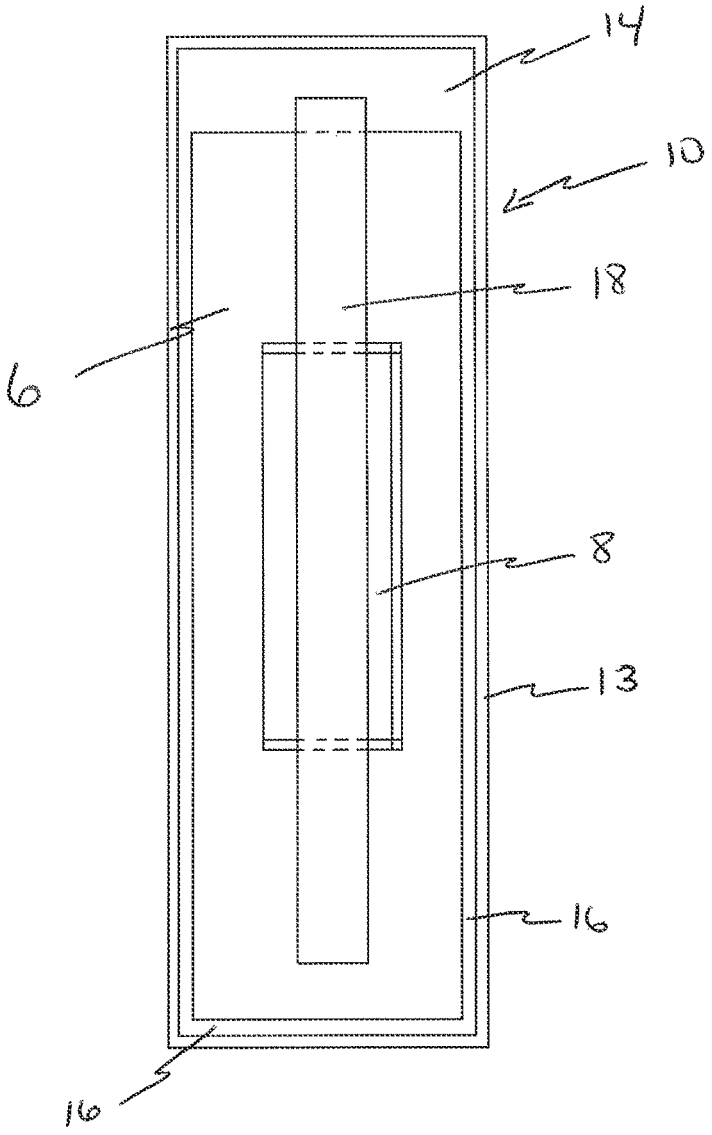
FIG. 4 is a bottom view of the footwear insert illustrated in FIG. 1 having one containment.

FIG. 4 illustrates the personal cooling device as shown in FIG. 1 using only a single liquid filled containment. In this embodiment, the containment is centrally located relative to the carrier component having the dry chemical reactant distributed thereon. The containment may be any shape or size, provided that it is adapted to rupture, holds the appropriate amount of liquid reactant(s), and releases the liquid for mixing with the dry chemical reactant(s) to create the cooling effect. As noted above, there may be any number of liquid filled containments depending on the design, from one to many containments. Furthermore, the at least one containment may be made from any known liquid-tight substrate to create the containment. By way of example only, the containment may be made from cellophane or the same material as the non-porous upper and lower components, such as a thin polyethylene film. The containment may be formed with the same sealing techniques as those described above with respect to the perimeter seal for the device. The frangible seam or seal may be made by weakening the seam, for example, by providing perforations along the length of the seam to decrease the pressure needed to burst the containment.

Figure 5:
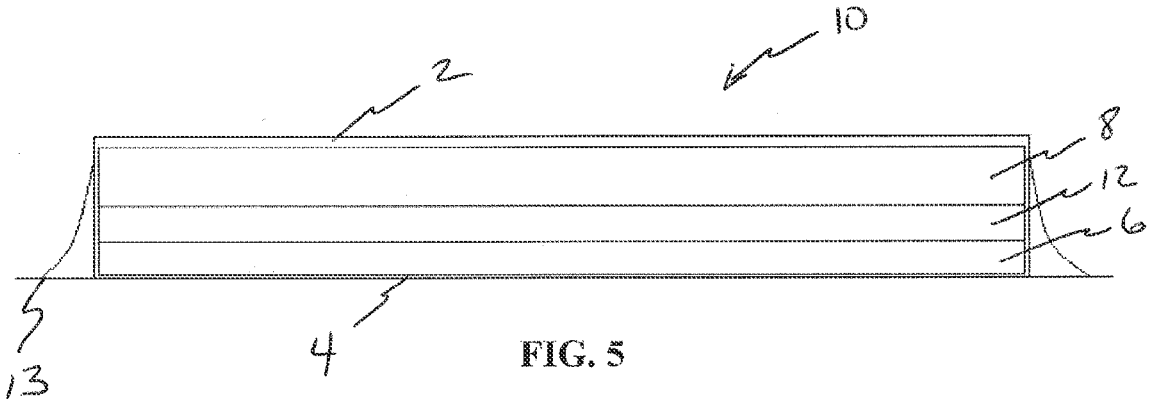
FIG. 5 is a cross-sectional side view of a personal cooling device in the form of a cold pack formed in accordance with the present invention.
Figure 6:
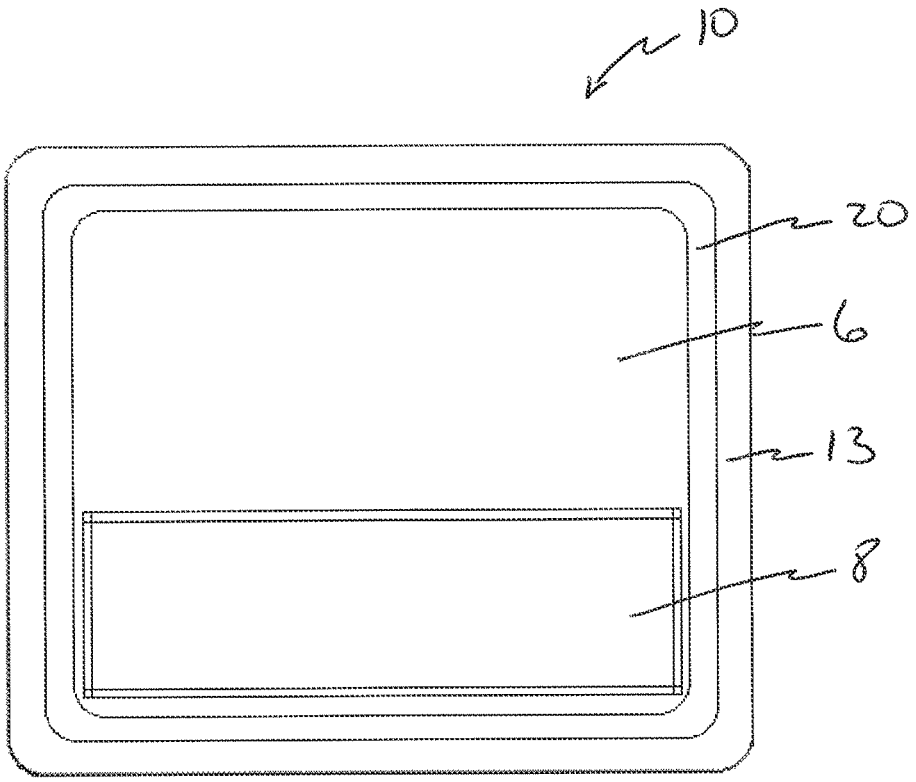
FIG. 6 is a top view of the personal cooling device illustrated in FIG. 5.
Figure 7:
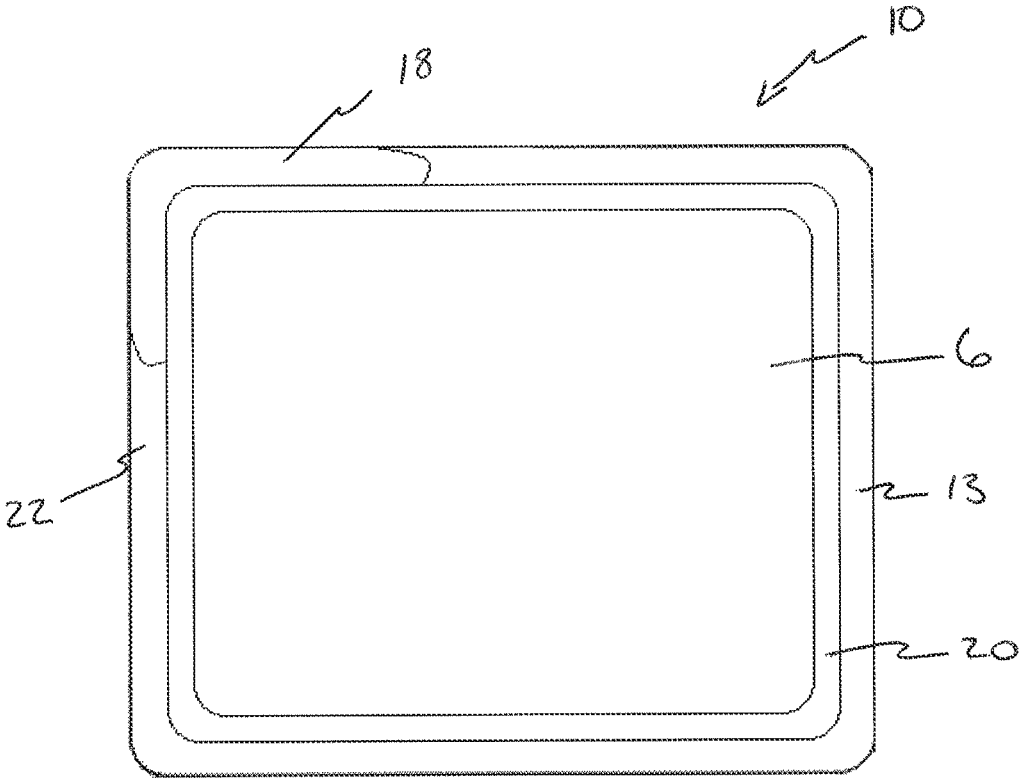
FIG. 7 is a bottom view of the personal cooling device illustrated in FIG. 5.

Referring to FIGS. 5-7, the present invention in the form of an instant cold pack to be applied to any area of the body is illustrated. FIG. 5 is a cross-sectional view of the personal cooling device which includes upper 2 and lower 4 non-porous components, preferably in the form of a plastic film such as polyethylene. Between the upper and lower components, there is provided an absorbent porous carrier component 6, a layer of dry chemical reactant(s) 12 such as urea, distributed over the surface area of the carrier component and at least one containment 8 for holding a liquid reactant(s), such as water, for creating an endothermic reaction with the dry chemical reactant(s). Similar to FIG. 1, the upper and lower components are overlapped and sealed along the perimeter. Prior to complete sealing, it is preferred to vacuum seal the device to remove air and tightly hold the at least one containment, carrier component and dry chemical reactant(s) in place during shipping, display, consumer transport and before use.

FIG. 6 is a top view of the personal cooling device shown in FIG. 5. As shown in FIG. 6, the device 10 includes a single liquid filled containment 8 and the carrier component is sized to leave a margin area 20 between the carrier component 6 and the perimeter seal 13. As discussed above, the containment 8 includes a plurality of frangible seals indicated by double lines in the embodiment illustrated in FIG. 6.

FIG. 7 is a bottom view of the personal cooling device 10 as shown in FIG. 5. The bottom preferably includes a skin compatible adhesive 18 which may be applied along the outer perimeter of the device for application to the user for hands-free use. The device 10 also preferably includes a release liner 22 to cover and protect the adhesive.

Figure 8:
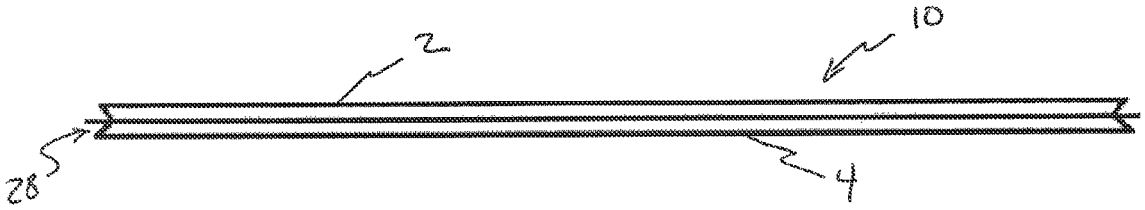
FIG. 8 is a side view of an alternative embodiment of the personal cooling device having folded edges.

FIG. 8 illustrates an alternative embodiment of the personal cooling device which uses an upper and/or lower non-porous component having folded edges similar to an accordion. The folded edges as shown in the side view of FIG. 8 provide a space to accommodate any negligible water or air that may still remain after the endothermic reaction has taken place within the device, e.g., in the footwear insert embodiment. By using the folded layer, there is no need to vacuum seal to remove any excess air and the margin area between the carrier component and perimeter seal becomes unnecessary. In this embodiment, the non-porous component having the folded edges may be made from any known plastic film or coated paper which can create an air-tight seal with the other non-porous component to encapsulate the carrier component, dry chemical reactant(s) and liquid filled containment(s). By way of example only, the dry chemical reactant(s) may be urea for providing a cooling affect. In use, the folded edge, when pressure is applied by e.g., a person walking on the footwear insert, will create space to accommodate any negligible air or water that might be present after the endothermic reaction has taken place. The remaining components of the personal cooling device as shown in FIG. 8 are the same as those shown in FIGS. 1-7.

The present invention is also directed to a method for making and for using a personal cooling device. The method of making the device includes the steps of providing a first flexible, non-porous substrate layer, placing an absorbent, porous carrier component on top of the first substrate layer, distributing a dry chemical reactant(s) over the surface of the carrier component, providing at least one liquid filled containment including a liquid(s) which, when mixed with the dry chemical reactant(s) creates an endothermic reaction, placing the at least one containment on top of the carrier component, providing a second flexible non-porous substrate placed on top of the at least one liquid filled containment, and sealing a perimeter of first and second non-porous substrate layers to encapsulate the carrier component, dry chemical reactant(s) and at least one liquid filled containment. The method further includes the step of vacuum sealing the first and second non-porous substrate layers to thereby tightly hold in place all the components of the device, especially maintaining a distribution of dry chemical reactant(s) over the surface area of the carrier component. The distribution of the at least one dry chemical reactant over the carrier component assures that, upon rupturing the at least one containment, the endothermic chemical reaction is evenly provided over the entire surface area of the carrier component. Moreover, since the at least one liquid reactant is absorbed by the absorbent porous carrier component, the resulting actual cooling provided by the device is consistently evenly distributed over the entire surface of the device irrespective of gravity and orientation with respect to the ground, e.g., when the consumer is using footwear inserts of this technology while keeping their feet in a raised position, such as upon the arm of a park bench.

The method of manufacture may further include the step of forming the at least one containment to include a seam having at least a portion thereof which is more easily ruptured than the remainder of the containment. As discussed above, the containment provides a structure for holding at least one liquid reactant such as, e.g., water. The containment may be made from film such as, e.g., cellophane having a liquid-tight seal therearound having at least one frangible portion to encapsulate the required volume of water. The purpose of the containment is to hold the at least one liquid reactant until it is desired to release the liquid to start the endothermic chemical reaction. As shown in FIG. 3, while the containment may take any size or shape, the containment in the form of a rectangle preferably includes at least one side seam or seal which is more easily ruptured due to applied pressure, e.g., by squeezing the containment by hand pressure. The seam or seal may be made more easily rupturable by adding perforations or by simply making a weaker seal. Any known method to those skilled in the art to make a weaker seal portion at some point in the containment seal is contemplated by the scope of the invention.

The present invention is also directed to a method of providing cooling to a target area of a user, such as, e.g., a footwear insert adapted to fit as an overlay on any footwear, orthotic or insole. The personal cooling device preferably includes a flexible non-porous upper component, a flexible non-porous lower component, a porous absorbent carrier component including at least one dry chemical reactant distributed over the surface area of the carrier component, and at least one containment adapted to hold at least one liquid chemical reactant. The upper and lower components are inseparably sealed to each other at their respective perimeters to form a volume adapted to encapsulate the carrier component, dry chemical reactant(s) and the at least one containment therebetween. By applying pressure, the containment is ruptured to release the at least one liquid chemical reactant which is absorbed by the carrier component to activate the at least one dry chemical reactant to produce an endothermic reaction, such that the distribution of the at least one dry chemical reactant on the carrier component provides an even temperature distribution over the entire surface area of the footwear insert irrespective of the pull of gravity and orientation of the footwear insert with respect to a walking surface. Alternatively, as discussed above, the cooling device of the present invention may be a cold pack which may be applied directly to a portion of the human body for relief from pain or discomfort.

The method of use also includes the step of providing an adhesive on the device to keep it in place when used as a footwear insert and to hold it to a user's body, hands free in the case of a cold pack. Thus, the method of use may include providing an adhesive to a bottom layer of the cooling device and removing a protective backing to expose the adhesive for application to any footwear, insole or orthotic or portion of a user's body.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A footwear insert for cooling a user's foot, said insert being initially rigid but becoming flexible after activation, said insert comprising:

flexible, non-porous upper and lower substrates shaped to conform to a contour of an insole of the footwear and sealed at their peripheries to form an interior volume extending over the entire area of the insert but for the sealed peripheries;

an absorbent carrier under the upper substrate and a frangible liquid containment under the absorbent carrier that are coextensive over the entire area of the insert except for margins and the sealed peripheries;

a chemical reactant between the frangible liquid containment and the absorbent carrier, and between the absorbent carrier and the upper substrate, said chemical reactant being distributed relative to the area of the absorbent carrier;

said chemical reactant comprising both (i) individual powder particles and (ii) individual pellets or globules that are larger than the powder particles; and an adhesive at a bottom side of the insert;

texture on an upper surface of the upper substrate configured to interact with the underside of a user's foot when the insert is in the footwear;

said upper and lower substrates being vacuum-sealed around the absorbent carrier, frangible liquid containment, chemical reactant, and margins thereby forming said insert and facilitating holding the absorbent carrier, frangible liquid containment, and chemical reactant in place between the substrates and maintaining the chemical reactant distributed relative to the area of the absorbent carrier;

wherein:

a liquid from the frangible liquid containment and the chemical reactant produce an endothermic reaction when in contact to thereby cause cooling;

the frangible liquid containment is configured to rupture in response to pressure, releasing said liquid from the frangible liquid containment to contact the chemical reactant and cause even cooling over the area of the absorbent carrier;

the absorbent carrier is initially rigid but becomes flexible following contact with the liquid after the frangible liquid containment is ruptured, thereby enabling the insert to conform to the contours of the insole of the footwear;

the individual powder particles and the individual pellets or globules in the chemical reactant provide both initial and extended cooling, wherein the larger individual pellets or globules extend the cooling beyond the period provided by the powder particles alone;

said margins comprise a margin at a toe area and a margin at the sides of the peripheral areas of the insert, the area of the margin at the toe area being greater than that of the margin at the sides of the peripheral areas of the insert;

said margins are configured to provide room in said interior volume for any excess air remaining after said vacuum-sealing or excess liquid after the frangible liquid containment is ruptured and the endothermic reaction starts;

said adhesive is configured to keep the insert in place by adhering and securing the insert only to the footwear after the insert is placed in the footwear and while cooling; and the absorbent carrier is configured to absorb cooling liquid resulting from the endothermic reaction and, upon pressure exerted by a user's foot in walking with the insert in place, to provide migration of some cooling liquid from a higher pressure area to a lower pressure of the insert.

2. The footwear insert of claim 1, wherein said frangible liquid containment comprises at least two individual compartments.

3. The footwear insert of claim 1, wherein the frangible liquid containment comprises one or more weakened portions configured to rupture under pressure and thereby release liquid from the frangible liquid containment in the insert.

4. The footwear insert of claim 1, wherein the chemical reactant is a dry reactant comprising said individual powder particles and said individual pellets or globules.

5. The footwear insert of claim 1, wherein said absorbent carrier comprises pores or openings and at least some of said individual powder particles of the chemical reactant enter into said pores or openings.

6. The footwear insert of claim 1, wherein said absorbent carrier comprises one or more porous materials.

7. The footwear insert of claim 1, wherein said frangible liquid containment encapsulates the liquid within a plastic material that has at least one weakened portion that facilitates rupture under pressure.

8. A method of making the footwear insert of claim 1, comprising:

providing said absorbent carrier, said frangible liquid containment configured to rupture under pressure, and said chemical reactant that comprises both of said individual powder particles and said individual pellets or globules that are larger than the powder particles, wherein the frangible liquid containment houses said liquid causing an endothermic reaction when in contact with said chemical reactant;

sealing the absorbent carrier, the frangible liquid containment, and the chemical reactant between said upper substrate and said lower substrate that are shaped to conform to a contour of said insole of the footwear, with the chemical reactant between the frangible liquid containment and the absorbent carrier, and between the absorbent carrier and the upper substrate and the chemical reactant, and distributed over the area of the absorbent carrier;

said sealing comprising evacuating unwanted air from the space between the upper and lower substrate by said vacuum-sealing, thereby facilitating holding the absorbent carrier, frangible liquid containment, and chemical reactant in place;

said sealing further comprising leaving said margins comprising said margin at said toe area and said margin at said sides of said peripheral areas of the insert, the area of the margin at the toe area being greater than that of the margin at the sides of the peripheral areas of the insert, thereby providing space between the upper and lower substrates where said excess liquid or said excess air can migrate after said frangible liquid containment has ruptured and said endothermic reaction has started.

9. The method of claim 8, further comprising providing said insert with said adhesive configured to adhere the insert only to the footwear and keep the insert in place in the footwear while a user's foot is being cooled by said endothermic reaction.

10. The method of claim 8, further comprising providing said frangible liquid containment with weakened portions configured to break under pressure to thereby rupture the frangible liquid containment.

* * * * *